United States Patent [19]

Georges et al.

[11] Patent Number: 4,828,227

[45] **Date of Patent: * May 9, 1989**

[54] INDUCTOR FOR THE INDUCTIVE REHEATING OF METALLURGICAL PRODUCTS

[75] Inventors: Philippe Georges, Terville; Bruno Wagner, Bar-sur-Aube, both of France

[73] Assignee: Institut de Recherches de la Siderurgie Francaise (IRSID), Maizieres-lès-Metz, France

[ * ] Notice: The portion of the term of this patent subsequent to Nov. 24, 2004 has been disclaimed.

[21] Appl. No.: 131,116

[22] Filed: Dec. 10, 1987

[30] Foreign Application Priority Data

Dec. 11, 1986 [FR] France ..... 86 17612

[51] Int. Cl.[4] ..... H05B 5/00; C21D 9/52

[52] U.S. Cl. ..... 266/90; 219/10.61 R; 219/10.79; 266/104; 266/129

[58] Field of Search ..... 266/90, 104, 129; 219/10.61 R, 10.79

[56] References Cited

U.S. PATENT DOCUMENTS

| | | | |
|---|---|---|---|
| 1,996,502 | 4/1935 | Brown | 219/47 |
| 2,010,622 | 8/1935 | Brown | 219/47 |
| 3,835,282 | 9/1974 | Sass et al. | 266/129 |
| 4,405,386 | 9/1983 | Mravic et al. | 266/129 |
| 4,687,894 | 8/1987 | Koga et al. | 219/10.43 |
| 4,708,325 | 11/1987 | Georges | 266/90 |

FOREIGN PATENT DOCUMENTS

| | | |
|---|---|---|
| 0170556 | 2/1986 | European Pat. Off. . |
| 2466306 | 10/1981 | France . |
| 2489645 | 5/1982 | France . |
| 2555353 | 5/1985 | France . |

OTHER PUBLICATIONS

Metals Handbook, vol. 4, Heat Treating, pp. 461–462, ©1981.

*Primary Examiner*—Christopher W. Brody
*Attorney, Agent, or Firm*—Nils H. Ljungman

[57] ABSTRACT

An inductor, used for the inductive reheating of metallurgical products is of the C-shaped magnetic yoke inductor type designed to straddle the product to be reheated. The free ends of the yoke have magnetic poles facing one another. The yoke comprises two polar legs and two intermediate connecting rods joined to one another at one of their ends and each articulated linked respectively to one polar leg by its other end, with the three joints thus formed having parallel axes.

This inductor is designed for use in the reheating of products which can have different thicknesses, in particular, for products in motion, for example, as they are being rolled.

18 Claims, 2 Drawing Sheets

INDUCTOR FOR THE INDUCTIVE REHEATING OF METALLURGICAL PRODUCTS

CROSS REFERENCE TO RELATED APPLICATIONS

U.S. application Ser. No. 867,503, filed on May 28, 1986, which issued into U.S. Pat. No. 4,708,325 on Nov. 24, 1987, and corresponds to French Laid Open patent application No. FR-A-2 583249, published on Dec. 12, 1986, which French patent application was filed in France on June 7, 1985, as French Ser. No. 85-08684. U.S. Pat. No. 4,708,324 is incorporated herein by reference as if the texts thereof were fully set forth herein.

BACKGROUND OF THE INVENTION

1. Field of the Invention

This invention relates to an inductor for the inductive reheating of metallurgical products. In particular, but not exclusively, this invention applies to the reheating of the edges of blanks for flat products in motion during their rolling on a rolling mill.

2. Description of the Prior Art

Different types of inductors have been developed for these applications and, in particular, the prior art includes magnetic yoke inductors in the shape of a "C", through the opening of which the product to be heated (edges of strip or wires or bars) passes. The free ends of the yoke face one another and are advantageously used as a support for the windings of the excitation electric current conductor, constituting wound magnetic poles with opposite polarities: e.g., French Laid Open patent application No. FR-A-2 489 645-(EDF), French Laid Open patent application No. FR-A-2 555 353-(CEM) or European Laid Open patent application No. EP-A-0 170-556 (EDF).

Another inductor of this type is described in FR-A-2 583 249, which corresponds to U.S. Ser. No. 867,503 cited above, both of which are expressly incorporated herein by reference as if the entire contents thereof were fully set forth herein. This document describes a C-shaped inductor articulated around an axis to allow separation of the two ends of the C, to facilitate the positioning of the inductor on the edge of the flat product, and primarily to keep the ends of the rolled strip, which exhibit a large curvature (ski), from hitting either of the poles of the inductor. For this purpose, one of the legs of the inductor is controlled so that it swings backward, pivoting around the axis of the joint, which increases the clearance and allows a larger cross section for passage of the product.

One of the important characteristics of this inductor is the special design of the joint, to ensure the best possible transmission of the magnetic flux by limiting the heating of the yoke at the level of the joint.

This inductor already has appreciable advantages, but it does not allow a correct reheating of products of varied dimensions and, in particular, of varied thicknesses. The inventors have discovered that, to use articulated C-shaped inductors to reheat products whose thickness is different from that for which these inductors were initially designed, varying the distance between the legs of the C, the results were unsatisfactory, and the efficiency of the heating process decreased.

OBJECT OF THE INVENTION

The object of the present invention is to eliminate this type of disadvantage by proposing an inductor whose gap can be adjusted to suit a broad range of products of different thicknesses, thereby making it possible to achieve maximum heating efficiency while ensuring uniform heating.

SUMMARY OF THE INVENTION

For this purpose, the invention proposes an inductor for the localized reheating of metallurgical products such as strip, wire or bars, in particular, for the reheating of the edges of blanks of flat products in motion during their rolling, of the type of a C-shaped magnetic yoke, comprising two polar legs, articulated in relation to one another to make it possible to modify the gap. The free ends of each leg also have excitation windings and form magnetic poles of opposite polarities which face one another. The inductor is characterized by the fact that, so that it can retain a specified relative orientation of the poles, in particular, their coaxiality, for different gaps, the yoke also comprises two intermediate rods connected to one another at one of their ends by a joint and each linked respectively to one of said polar legs of the yoke by its other end. The three joints formed in this manner have parallel axes of rotation.

By means of the inductor according to the invention, it is possible to achieve maximum heating efficiency and symmetry of the heated profile. The efficiency tends to decrease as the gap or the gaps of the magnetic circuit constituted by the yoke and the product to be reheated increases.

The inventors have discovered that when a C-shaped inductor of the type described above with a single joint is used, the gaps can only be maintained at the minimum value of maximum efficiency if the polar surfaces are parallel to the surfaces of the reheated product, and preferably generally parallel to one another. It follows that, when the inductor has only one joint, there is only one product thickness which allows the device to operate at maximum efficiency. For other product thicknesses, the polar faces will be inclined in relation to the corresponding product surfaces, which requires an increase of the gaps.

The inventors have also discovered that for reheating bars (e.g., with a circular cross section), if the polar surfaces of the inductor are not parallel, the temperature profile inside the product is asymmetrical, i.e., the temperature is higher in the part of the product located where the surfaces are closest to one another.

By means of the three joints of the inductor according to the invention, it is easy to position and keep the polar faces parallel to one another, even if the product thickness varies.

In a related manner, the position and the orientation of each pole can be adjusted for products with a special cross section, or for a specified heat profile (reheating corners on flat products or bars with a polygonal cross section, for example, or modifications of an existing temperature profile).

It is apparent that the principal advantage offered by the invention is the flexibility of utilization of the inductor articulated at three points which, by means of the variable geometry of its yoke, makes it possible to solve practically all of the problems of reheating flat products or long products with a regularly-shaped cross section, remaining, of course, within the limits set by the dimensions of the different parts of the inductor. On this subject, it will be noted that, by replacing the small rods with longer rods, the range of product thicknesses which can be reheated can be increased, without the need to replace the polar legs of the "C" and the windings they support at their free ends.

One aspect of the invention resides broadly in an inductive heater for the localized reheating of at least one elongated metallurgical product, the elongated metallurgical product being chosen from at least one member of the group consisting essentially of strips, plates, profiles, wires and bars. The inductive heater has poles having pole ends between which pole ends the at least one product is positionable for localized reheating. The pole ends have longitudinal axes. The inductive heater also has an arrangement for generating a magnetic field between the pole ends for the localized heating of the at least one product, and an arrangement for selectively positioning the pole ends at least substantially coaxially to the longitudinal axes of one another as the pole ends change position with respect to one another.

Another aspect of the invention resides broadly in an inductive heater for the localized reheating of at least one elongated metallurgical product, the elongated metallurgical product being chosen from at least one member of the group consisting essentially of strips, plates, profiles, wires and bars, in particular for reheating the edges of blanks for flat products in motion during rolling. The heater comprises a magnetic yoke comprising two poles, the poles having pole ends between which pole ends the at least one product is positionable for localized reheating, the poles being linked to one another for modifying a gap being defined by the polar ends. The pole ends have longitudinal axes. The heater also comprises an arrangement for generating a magnetic field between the pole ends for the localized heating of the at least one product. The magnetic yoke comprises a first joint, a second joint and a third joint. Two bar members are connected to one another by a first joint disposed at one end of each of the bar members. The other ends of the bar members are connected to the pole ends by the second and the third joints, each of the joints having axes of rotation being substantially parallel to one another. The three joints are disposed for selectively maintaining a specified relative orientation of the pole ends including selectively maintaining coaxiality of the longitudinal axes thereof for different gaps between the pole ends.

Other characteristics and advantages are explained in greater detail in the following description of embodiments of the inductor according to the invention.

DESCRIPTION OF THE PREFERRED EMBODIMENTS

Figure 1:
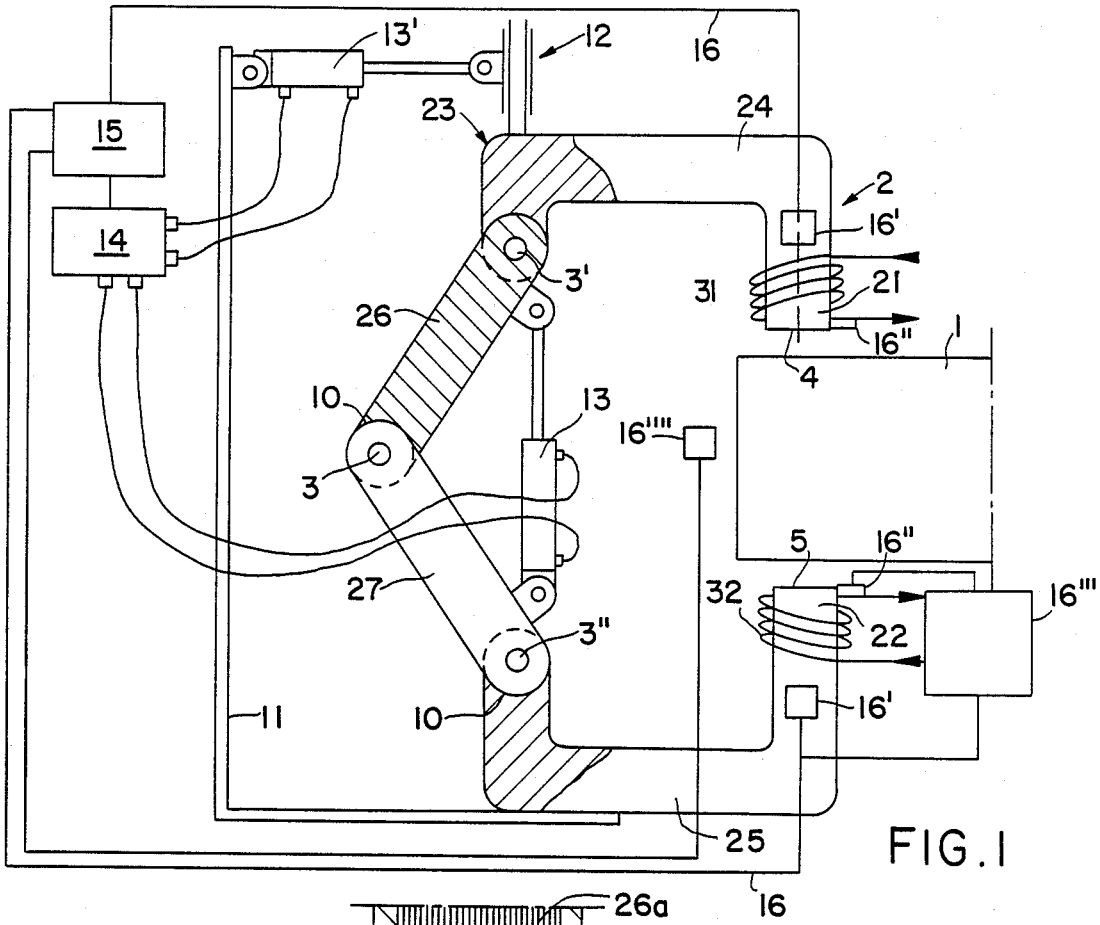
FIG. 1 is a schematic diagram of the inductor with three joints.

FIG. 1 shows an inductor 2 in the position for reheating the edge of a steel plate 1 before rolling. The plate 1 is inserted between two poles 21 and 22 of opposite polarity of the inductor 2. The yoke 23 consists of an upper polar leg 24, a lower polar leg 25 and two intermediate rods 26 and 27. The rods or bars are connected to one another at one end by means of a joint 3. A similar joint 3', 3" connects the other end of each rod respectively to one of the polar legs 24, 25 at their end opposite the poles.

Figure 2:
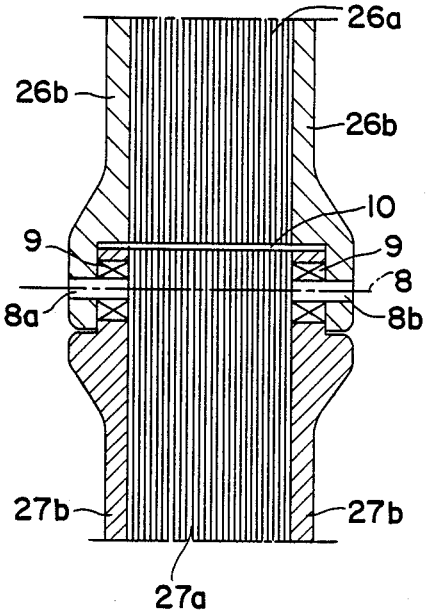
FIG. 2 is a cross section showing a preferred realization of a joint, preferably being between two rods.

The polar legs, like the rods, are preferably constituted of laminated ferromagnetic sheets 26*a*, 27*a*, as shown in FIG. 2. For this reason, the legs and rods generally have a rectangular cross section, but other cross section could also be considered (e.g., an essentially circular cross section, in particular at the level of the poles 21, 22 of the inductor).

The magnetic poles 21, 22 of the inductor are formed by the free ends of the two legs 24, 25 pointing toward one another, with the end surfaces of the poles or polar surfaces 4, 5 facing one another.

The conductor windings 31, 32, supplied with electric current from an alternating current voltage source, such as a coil current controller 16''', are preferably positioned at or close to the extreme ends of the poles 21 and 22 adjacent to the polar surfaces 4 and 5, to prevent magnetic flux losses and to ensure maximum efficiency of operation.

As noted above, an important advantage of the inductor articulated according to the invention is that it makes it possible to minimize the space between the pole and the product, while keeping the polar surfaces parallel to the surfaces of the product.

In the case of a product which exhibits a beveled cross section, the polar ends could also be realized with a bevel with a corresponding slope, to maintain the coaxiality of the conductor windings on the poles. In this case, it is easy to see that the windings will be farther away from the product on account of their obliqueness in relation to the surface of the product.

Since this separation is sometimes somewhat detrimental to the transmission of the flux, and thus to the efficiency of the heating, it is preferable to dispose the end surfaces of the poles, or polar surfaces 4, 5, perpendicular to the axis of the windings and thus, of the poles. This is all the more logical since the products processed generally have a cross section with a simple geometry and, in particular, have parallel surfaces which leads to the polar surfaces being preferably parallel to one another, and thus, to the poles preferably being coaxial.

FIG. 2 is a diagram of the joint 3 of the two small rods 26 and 27 in relation to one another. The other joints 3' and 3" are realized in a similar manner.

The two small rods pivot on one another according to an axis of rotation 8. The laminations 26*a* and 27*a*, whose sheets preferably are placed in planes perpendicular to the axis 8 of the joint 3, are clamped between side plates 26*b* and 27*b* which hold the joint. For this purpose, two half shafts or pivots 8*a* and 8*b*, which preferably do not traverse the laminated sheets, but which are aligned along the axis 8 on both sides of said laminated sheets, are bound in the side plates 26*b* forming a fork. The external housings of bearings 9 are formed by the side plates 27*b*. The external housings, the joint 3 and the legs are formed in and bounded by the side plates 27*b*. During assembly, the side plates 26*b* sit astride the side plates 27*b* at the level of the joint, so that only a small operational clearance 10 remains between the facing laminates, resulting in a minimal magnetic leak flux. This clearance 10 is as small as possible, and the parts of the joint may even be substantially in almost virtual contact in an alternate embodiment, not shown.

FIGS. 3*a*–3*f* are a schematic diagram of several possible embodiments and utilizations of a single inductor according to the invention.

Figure 3A:
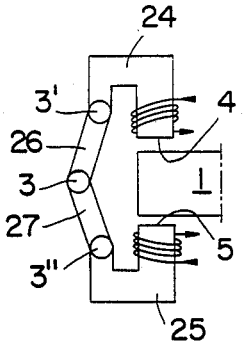
FIGS. 3*a*–3*f* are schematic diagrams of different configurations and utilizations of the inductor as a function of the shape and size of the products to be processed.
Figure 3B:
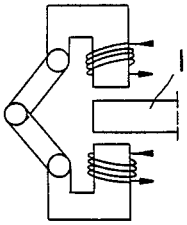

In FIG. 3*a*, the inductor is used to reheat the edges of a thick flat product. In FIG. 3*b*, it is used in the same manner on a thinner product. It is apparent that in both cases, the polar surfaces 4, 5 remain parallel to the surface of the product 1, and also parallel to one another. The axes of the joints of the upper and lower polar legs 24 and 25, respectively, can be brought closer to one another by a translational movement over a trajectory parallel to the common axis of the poles; the rods 26, 27 form shears which close when the legs come closer together.

Figure 3C:
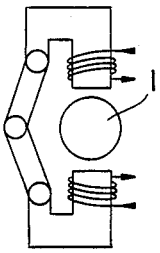
Figure 3D:
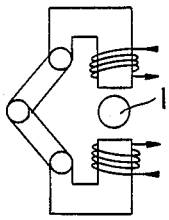

FIGS. 3*c* and 3*d* show the same configuration as in FIGS. 3*a* and 3*b*, but applied to bars with a circular cross section.

Figure 3E:
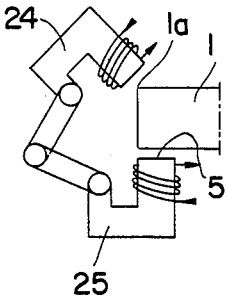

FIG. 3*e* represents a particular arrangement, specifically adapted to the reheating of the corner peak 1*a* of a flat product 1. This figure illustrates the flexibility of use of the device and its adaptability to very diverse utilizations. It can be noted that the lower polar leg 25 is held in a position such that the lower polar surface 5 is parallel to the large surface of the product, while the upper polar leg 24 is offset at an angle toward the smaller surface of the product, so that the upper pole is directly and exclusively facing the upper corner 1*a* of the edge of the product 1.

Figure 3F:
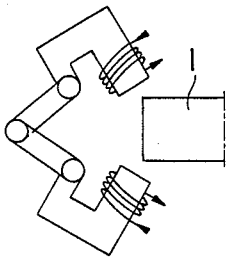

FIG. 3*f* shows another configuration which can be assumed by the inductor articulated at three points, here adapted to the reheating of the upper and lower corners of the product 1.

Of course, other configurations are possible. The only limits to the utilization of the C-shaped inductor according to the invention are dictated by space limitations. Even if, from a magnetic point of view, there is nothing to prevent very long polar legs and rods, without any great loss of flux thanks to the special design of the joints, it is easy to see that very long rods are not justified if the products processed generally have a low thickness or a small cross section.

It is also possible to envision an automatic positioning of the inductor poles according to the cross section of the product to be reheated, such as according to its thickness, or even according to the cross section of the heating profile measured upstream of downstream of the reheating installation using inductors of this type.

The movement of the poles can be controlled continuously by mechanical or electrical activation means or jacks, e.g., those described in the aforementioned FR-A-2 583249, and incorporated by reference as if the entire contents thereof were fully set forth herein. Likewise, thereby, the position of the entire inductor in relation to the rolling line can be adapted to the width of the product.

FIG. 1 shows schematically a system for controlling the relative positioning of the poles. The two ends of a jack 13 are respectively linked to the two rods 26, 27. Another jack 13' is linked on one hand to a rigid support 11 connected to the lower leg 25, and on the other hand to a guide 12, the base or rod portion of which is fixed to the upper leg 24.

The two jacks are connected to an activator 14 controlled by a controller 15. There are also mounted various sensors in relation to the inductor, e.g., a position sensor (connection shown schematically by lines 16 and blocks 16' in FIG. 1). The line 16 and position sensor 16' are connected to the controller 15. Other sensors 16'' are preferably installed, e.g., to measure the temperature of, for example, the product 1. The sensors 16'', in an alternative embodiment, preferably control the coil current controllers 16''', only one of which is shown in FIG. 1. The position sensors 16' also, in yet an alternative embodiment, preferably automatically position the inductor poles as a function of the product, as described above. The position sensors 16' and other sensors may, in another alternative embodiment, control the coil current controllers 16'''. A thickness and cross section sensor 16'''', either independently or in conjunction with the position sensors 16', may also control the controller 15 in a yet another alternative embodiment of the invention.

It is important to note that the different position regulations of the poles can be realized continuously, and preferably automatically, without manual intervention, and even by means of the linkage described above, during operation, without interrupting the feed to the polar windings or significantly modifying the characteristics of the magnetic circuit.

In one particular embodiment of the inductor, there could also be means to guide the upper and lower polar legs by the outputs of the position sensors 16' to the controller 15, so that the wound poles and the coils 21 and 22 are kept coaxial, whatever the opening of the inductor.

The invention as described hereinabove in the context of the preferred embodiments is not to be taken as limited to all of the provided details thereof, since modifications and variations thereof may be made without departing from the spirit and scope of the invention.

What is claimed is:

1. An inductive heater for the localized reheating of at least one metallurgical product, said metallurgical product being chosen from at least one member of the group consisting essentially of strips, plates, profiles, wires and bars;

said inductive heater comprising:

poles having pole ends between which pole ends said at least one product is positionable for localized reheating;

said pole ends having longitudinal axes;

means for generating a magnetic field between said pole ends for said localized heating of the at least one product; and means for selectively positioning said pole ends at least substantially coaxially to said longitudinal axes of one another as said pole ends change position with respect to one another.

2. The inductive heater according to claim 1, including additional means for selectively positioning said pole ends, said additional means for selectively positioning said pole ends being for positioning said pole ends in positions where said longitudinal axes make angles greater than substantially zero degrees with respect to one another as said pole ends change position with respect to one another.

3. An inductive heater for the localized reheating of at least one metallurgical product, said metallurgical product being chosen from at least one member of the group consisting essentially of strips, plates, profiles, wires and bars, in particular for reheating the edges of blanks for flat products in motion during rolling, said heater comprising:

a magnetic yoke comprising two poles, said poles having pole ends between which pole ends said at least one product is positionable for localized reheating, said poles being linked to one another for modifying a gap being defined by said polar ends;

said pole ends having longitudinal axes;

means for generating a magnetic field between said pole ends for said localized heating of the at least one product;

said magnetic yoke comprising:

a first joint, a second joint and a third joint;

two bar members being connected to one another by a first joint disposed at one end of each of said bar members;

the other ends of said bar members being connected to said pole ends by said second and said third joints, each of said joints having axes of rotation being substantially parallel to one another;

said three joints being disposed for selectively maintaining a specified relative orientation of the pole ends including selectively maintaining coaxiality of the longitudinal axes thereof for different gaps between said pole ends.

4. The inductive heater according to claim 3, wherein said means for generating a magnetic field comprises coils disposed on said pole ends.

5. The inductive heater according to claim 3, wherein said pole ends have pole faces substantially facing one another.

6. The inductive heater according to claim 3, wherein said magnetic yoke is substantially C-shaped.

7. The inductive heater according to claim 4, wherein said magnetic yoke is substantially C-shaped.

8. The inductive heater according to claim 5, wherein said pole faces of said pole ends are of opposite polarity.

9. The inductive heater according to claim 4, wherein said pole faces of said pole ends are of opposite polarity.

10. The inductive heater according to claim 3, wherein said pole ends and said bar members of the magnetic yoke are each formed by laminated ferromagnetic sheets, each said pole ends and said bar members having two side plates, said axes of rotation each comprise two pivots disposed on either side of the laminated sheets and coaxial with their corresponding axis.

11. The inductive heater according to claim 10, wherein said pivots solely extend through their corresponding side plates disposed at their corresponding joint thereby minimizing reluctance of said yoke.

12. The inductive heater according to claim 4, wherein said pole ends and said bar members of the magnetic yoke are each formed by laminated ferromagnetic sheets, each said pole ends and said bar members having two side plates, said axes of rotation each comprise two pivots disposed on either side of the laminated sheets and coaxial with their corresponding axis.

13. The inductive heater according to claim 6, wherein said pole ends and said bar members of the magnetic yoke are each formed by laminated ferromagnetic sheets, each of said pole ends and said bar members having two side plates, said axes of rotation each comprise two pivots disposed on either side of the laminated sheets and coaxial with their corresponding axis.

14. The inductive heater according to claim 10, wherein each said joint has an operational gap having a cylindrical portion at each said gap, each said gap being disposed between facing ones of said laminated sheets of each of the two elements being joined by their corresponding joint.

15. The inductive heater according to claim 11, wherein each said joint has a operational gap having a cylindrical portion at each said gap, each said gap being disposed between facing ones of said laminated sheets of each of the two elements being joined by their corresponding joint.

16. The inductive heater according to claim 3, wherein said pole faces are perpendicular to the longitudinal axes of the pole ends.

17. The inductive heater according to claim 4, wherein said pole faces are perpendicular to the longitudinal axes of the pole ends.

18. The inductive heater according to claim 3, wherein said products are products movable between said pole ends while said products are being rolled.

* * * * *